US008439479B2

(12) United States Patent
Yamada et al.

(10) Patent No.: US 8,439,479 B2
(45) Date of Patent: May 14, 2013

(54) LIQUID EJECTING APPARATUS

(75) Inventors: Yoichi Yamada, Shiojiri (JP); Kiyoteru Katsuki, Azumino (JP); Masaru Kobashi, Matsumoto (JP); Daisuke Matsumoto, Matsumoto (JP); Yasunori Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 113 days.

(21) Appl. No.: 12/940,272

(22) Filed: Nov. 5, 2010

(65) Prior Publication Data

US 2011/0109709 A1 May 12, 2011

(30) Foreign Application Priority Data

Nov. 11, 2009 (JP) ..... 2009-257713
Apr. 28, 2010 (JP) ..... 2010-103893

(51) Int. Cl.
*B41J 2/165* (2006.01)
*B41J 2/01* (2006.01)

(52) U.S. Cl.
USPC ..... 347/34; 347/104

(58) Field of Classification Search ..... None
See application file for complete search history.

(56) References Cited

U.S. PATENT DOCUMENTS 5,298,926 A * 3/1994 Fukushima et al. ..... 347/34
5,751,308 A * 5/1998 Gandy et al. ..... 347/33
5,896,148 A * 4/1999 Fukushima et al. ..... 347/67
6,097,408 A * 8/2000 Fukushima et al. ..... 347/34
6,152,445 A * 11/2000 Hirota et al. ..... 271/315
6,802,591 B2 * 10/2004 Takahashi ..... 347/36
2006/0181589 A1 * 8/2006 Nishida ..... 347/104
2007/0091146 A1 * 4/2007 Endo et al. ..... 347/55
2009/0231387 A1 * 9/2009 Shinkawa ..... 347/34
2010/0032891 A1 * 2/2010 Togashi et al. ..... 271/18.1
2010/0165063 A1 * 7/2010 Abramovitch ..... 347/101

FOREIGN PATENT DOCUMENTS

JP 2003-165230 6/2003
JP 2007-118318 5/2007
JP 2007-118320 5/2007
JP 2007-118321 5/2007
JP 2008-213255 9/2008

* cited by examiner

*Primary Examiner* — Stephen Meier
*Assistant Examiner* — Leonard S Liang
(74) *Attorney, Agent, or Firm* — Workman Nydegger

(57) ABSTRACT

A liquid ejecting apparatus having a liquid ejecting unit that ejects liquid toward a target ejection medium and a target ejection medium support member that is disposed so as to oppose the liquid ejecting unit and supports the target ejection medium, includes a conductive shielding member that covers a first side of the target ejection medium, which opposes the liquid ejecting unit, at an edge area including an edge perpendicular to a feeding direction of the target ejection medium.

5 Claims, 4 Drawing Sheets

LIQUID EJECTING APPARATUS

BACKGROUND

1. Technical Field

The present invention relates to liquid ejecting apparatuses such as facsimile machines and printers.

2. Related Art

As an example of liquid ejecting apparatuses, an exemplary ink jet printer will be described below. An ink jet printer is provided with an inkjet recording head and a support member (also referred to as a platen) which is arranged so as to oppose the ink jet recording head. The ink jet printer is configured such that when a recording sheet is supported by the support member, a distance is defined between the ink jet recording head and the recording sheet.

In recent years, development of ink jet printers has been carried out with the aim of further improving the quality of recording by minimizing the size of each ink droplet, which is minimized to for example several picoliters. As a result, when those ink droplets are ejected from the ink jet recording head toward the recording sheet, some of them may not land on the recording sheet because the mass of each ink droplet is extremely small. They may remain suspended as a mist, thereby leading to various problems. Further, in so-called borderless recording in which recording is performed without leaving margins on all four sides of a recording sheet, ink droplets are also ejected toward an area outside the edges of the recording sheet, which makes the above described phenomenon of mist suspension more apparent.

Under these circumstances, patent documents such as JP-A-2007-118321 and JP-A-2007-118318 disclose a technique in which a potential difference is applied across an ink jet recording head, a recording sheet and a support member, and thus an electric field is generated, allowing the Coulomb force to act on ink droplets so that the ink droplets are attracted to the recording sheet.

1. Problems Associated with the High Speed Transportation of Recording Sheets

Recently, ink jet printers have been proposed which are capable of recording with extremely high throughput by employing stationary ink jet recording heads, also referred to as line heads, which do not require performance of a scanning (moving) operation. In such ink jet printers, recording sheets are transported within the apparatus through a sheet transportation path at an extremely high speed.

However, such high speed transportation of recording sheets has been found to cause some problems such as those described below. That is, if no control of the electric potential is performed on the recording sheet, the support member (platen), and the ink jet recording head (hereinafter collectively referred to as "recording unit components"), an electric field generated across the recording unit components may cause a problem such that paper dust, which has been created during cutting and attached on the edges of recording sheets, flying toward the ink jet recording head and adhering thereto. In particular, when recording sheets are transported at a high speed, greater vibration or impact will occur during the transportation, thereby causing a more significant amount of flying paper dust.

Furthermore, through friction between the recording sheets accommodated in a sheet cassette or sliding contact or contact between components in the transportation path (e.g., an edge guide or a transportation roller) and the recording sheets, frictional charging or separation charging is increased, thereby causing the recording unit components to be more strongly charged. As a result, the electric field generated across the recording unit components becomes strong, and thus electrostatic charge on paper dust per se also becomes strong, thereby Coulomb force exerting on paper dust will be increased. This may result in more pronounced paper dust adhesion to the ink jet recording head.

In addition, even when paper dust per se is not charged, the flying paper dust in the electric field is subjected to dielectric polarization or electrostatic induction which causes imbalance of electric charges in paper dust, resulting in paper dust being attracted toward the ink jet recording head.

FIG. 4 is an explanatory view showing the above problem, in which reference numerals 160 and 160*a* denote an ink jet recording head and a nozzle plate, respectively. Reference numeral 170 denotes a support member (a platen) and reference numeral 170*a* denotes each rib formed on the support member 170. Further, reference symbol P denotes a recording sheet, reference symbol Pe denotes an edge of the recording sheet P, and reference symbol d denotes a piece of paper dust. Circled plus and minus signs indicate the respective charging polarities.

The recording sheet P is neutralized, for example by means of a neutralization brush, and therefore the paper dust d attached on the recording sheet P is not charged. However, as illustrated in the enlarged view of the paper dust d, when the nozzle plate 160*a* is positively charged and the support member 170 is negatively charged as an example, negative charges in the paper dust d move toward a surface closer to the nozzle plate and the positive charges in the paper dust d move toward another surface closer to the support member, due to dielectric polarization (when the paper dust d is dielectric in nature) or electrostatic induction (when the paper dust d is conductive in nature). As a result, the paper dust d may be attracted toward either the nozzle plate 160*a* or the support member 170.

When the paper dust d adheres to the inkjet recording head, the paper dust directly obstructs the nozzle openings or, alternatively, moves onto nozzle openings during cleaning (wiping) of the nozzle surface, which may lead to missing dots.

In addition to the above described case in which the paper dust d physically obstructs the nozzle openings, filler which constitutes the paper dust d, such as calcium carbonate, may react with water in the ink and become thicker, thereby disturbing the meniscus vibration at the nozzle openings and interfering with ejection of ink droplets. Therefore, it is quite important to avoid paper dust adhesion to the ink jet recording head in order to achieve appropriate quality of recording in the ink jet printer.

2. Problems in the Related Art

As described above, JP-A-2007-118321 and JP-A-2007-118318 disclose a technique in which a potential difference is applied across the ink jet recording head, the recording sheet and the support member (recording unit components), and thus an electric field is generated, causing the Coulomb force to act on ink droplets so that the ink droplets are attracted to the recording sheet. Accordingly, if paper dust were to be simply considered in the same way as ink droplets, it is thought that it would be possible to prevent paper dust adhesion to the ink jet recording head by controlling an electric field so as to attract paper dust toward the recording sheet.

However, filler and cellulose fibers which constitute paper dust can be either positively or negatively charged according to the triboelectric series. If an electric field in a certain direction is applied across the recording unit components, in an attempt to prevent paper dust from flying toward the ink jet recording head, paper dust will be charged to the opposite polarity, resulting in failure to prevent them from flying toward the ink jet recording head.

JP-A-2003-165230, which addresses the prevention of paper dust, dust particles or the like from adhering to the periphery of a nozzle unit of an ink jet recording head, as one of the advantages of the invention, discloses a recording apparatus which includes an air duct provided around the nozzle plate and is configured to blow humidified air from the air duct during recording and recording stand-by period. However, with such a configuration, the device would be larger in size and of higher cost due to complexity of the configuration. In addition, the air blown from the air duct may undesirably cause paper dust to adhere to the recording head.

Further, JP-A-2008-213255 discloses a technique for collecting paper dust by means of a charged paper dust collecting member. However, this technique has some problems in that the paper dust collecting member does not always effectively collect paper dust due to the above mentioned opposite polarity, and paper dust accumulated on the paper dust collecting member needs to be disposed of (removed). In particular, when a significant amount of paper dust is accumulated, a slight vibration or impact may cause paper dust to be released into the air, which makes it difficult to maintain the performance over a long period of time.

SUMMARY

An advantage of some aspects of the invention is that adhesion of paper dust, dust particles or the like (hereinafter referred to as "paper dust") to the ink jet recording head is prevented with certainty without compromising the quality of recording.

According to an aspect of the invention, there is provided a liquid ejecting apparatus having a liquid ejecting unit that ejects liquid toward a target ejection medium, and a target ejection medium support member disposed so as to oppose the liquid ejecting unit and supports the target ejection medium, the liquid ejecting apparatus including: a conductive shielding member that covers a first side of the target ejection medium, which opposes the liquid ejecting unit, at an edge area including an edge perpendicular to a feeding direction of the target ejection medium.

Accordingly, the conductive shielding member is provided to cover the edge area of the target ejection medium, where paper dust adhesion is most likely to occur, and therefore it is possible to physically prevent paper dust from flying toward the liquid ejecting unit. Moreover, the conductive shielding member is electrically conductive, and therefore it is also possible to prevent frictional charging of paper dust caused by the friction between the liquid ejecting unit and the conductive shielding member, thereby preventing paper dust from flying due to electrostatic charging.

Further, in the above aspect of the invention, the conductive shielding member may be configured so as not to be in contact with the first side of the target ejection medium. Accordingly, the conductive shielding member is provided so as not to be in contact with (i.e., so as not to contact) the target ejection medium, therefore the conductive shielding member will not physically scrape paper dust attached to the edge area of the target ejection medium, thereby eliminating flying paper dust.

Further, in the above aspect of the invention, the liquid ejecting apparatus may include an equipotential forming unit that applies the same potential to the conductive shielding member and a specified portion of the liquid ejecting unit.

Accordingly, the conductive shielding member and the specified portion of the liquid ejecting unit are set to the same potential, resulting in an extremely weak or almost no electric field being formed between the conductive shielding member and the specified portion of the liquid ejecting unit (hereinafter referred to as "no electric field state" for convenience). That is, since there is no electric field between the conductive shielding member and the liquid ejecting unit, and thus no Coulomb force acts on paper dust, it is possible to prevent paper dust from flying toward the liquid ejecting unit and adhering thereto.

Further, in the above aspect of the invention, the liquid ejecting apparatus may include a target ejection medium transportation unit that is disposed upstream from the liquid ejecting unit and transports the target ejection medium, wherein the conductive shielding member may be disposed in the feeding direction of the target ejection medium between the liquid ejecting unit and the target ejection medium transportation unit.

Accordingly, the conductive shielding member is disposed in the feeding direction of the target ejection medium between the liquid ejecting unit and the target ejection medium transportation unit, and therefore it is possible to prevent paper dust from flying toward the liquid ejecting unit and adhering thereto, especially when paper dust is released from the target ejection medium due to vibration as a trailing edge of the target ejection medium passes through the target ejection medium transportation unit.

Further, in the above aspect of the invention, the target ejection medium transportation unit may include a roller configured to rotate while being in contact with the first side of the target ejection medium, and a cover member that covers an outer peripheral surface of the roller, wherein the conductive shielding member may be mounted on the cover member.

Accordingly, the target ejection medium transportation unit includes the roller configured to rotate while being in contact with the first side of the target ejection medium, and the cover member that covers the outer peripheral surface of the roller, and therefore it is possible to prevent paper dust from flying from the roller, where paper dust adhesion is likely to occur. Moreover, the conductive shielding member is mounted on the cover member, and therefore the cost of mounting the cover member can be reduced due to the simplified mounting structure.

Further, in the above aspect of the invention, the target ejection medium transportation unit may include a roller configured to rotate while being in contact with the first side of the target ejection medium, and a cover member that covers an outer peripheral surface of the roller, the cover member having a contact portion formed thereon which is in contact with the target ejection medium, wherein the conductive shielding member may be mounted on the cover member, and wherein the cover member may be electrically conductive and connected to an equipotential forming unit so that the cover member is set to the same potential as that of a specified portion of the liquid ejecting unit and the conductive shielding member.

Accordingly, the cover member enables paper dust to be prevented from flying from the roller, where paper dust adhesion is likely to occur. Moreover, the conductive shielding member is mounted on the cover member, and therefore the cost of mounting the cover member can be reduced due to the simplified mounting structure. Moreover, the cover member is set to the same potential as that of a specified portion of the liquid ejecting unit and the conductive shielding member, resulting in a state of no electric field formed therebetween, thereby more reliably preventing paper dust from flying toward the liquid ejecting unit and adhering thereto.

Further, in the above aspect of the invention, the cover member may be configured so as not to be in contact with the first side of the target ejection medium at least at the edge area.

Accordingly, the cover member is provided so as not to be in contact with the first side of the target ejection medium at least at the edge area, and therefore the cover member will not physically scrape paper dust attached to the edge area of the target ejection medium, thereby eliminating flying paper dust.

Further, in the above aspect of the invention, a plurality of the conductive shielding members may be provided and arrayed in a direction perpendicular to the feeding direction of the target ejection medium so as to accommodate different sizes of target ejection mediums.

Accordingly, the plurality of the conductive shielding members are provided and arrayed in the direction perpendicular to the feeding direction of the target ejection medium so as to accommodate different sizes of the target ejection mediums, therefore it is possible to accommodate a variety of target ejection mediums according to their sizes.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
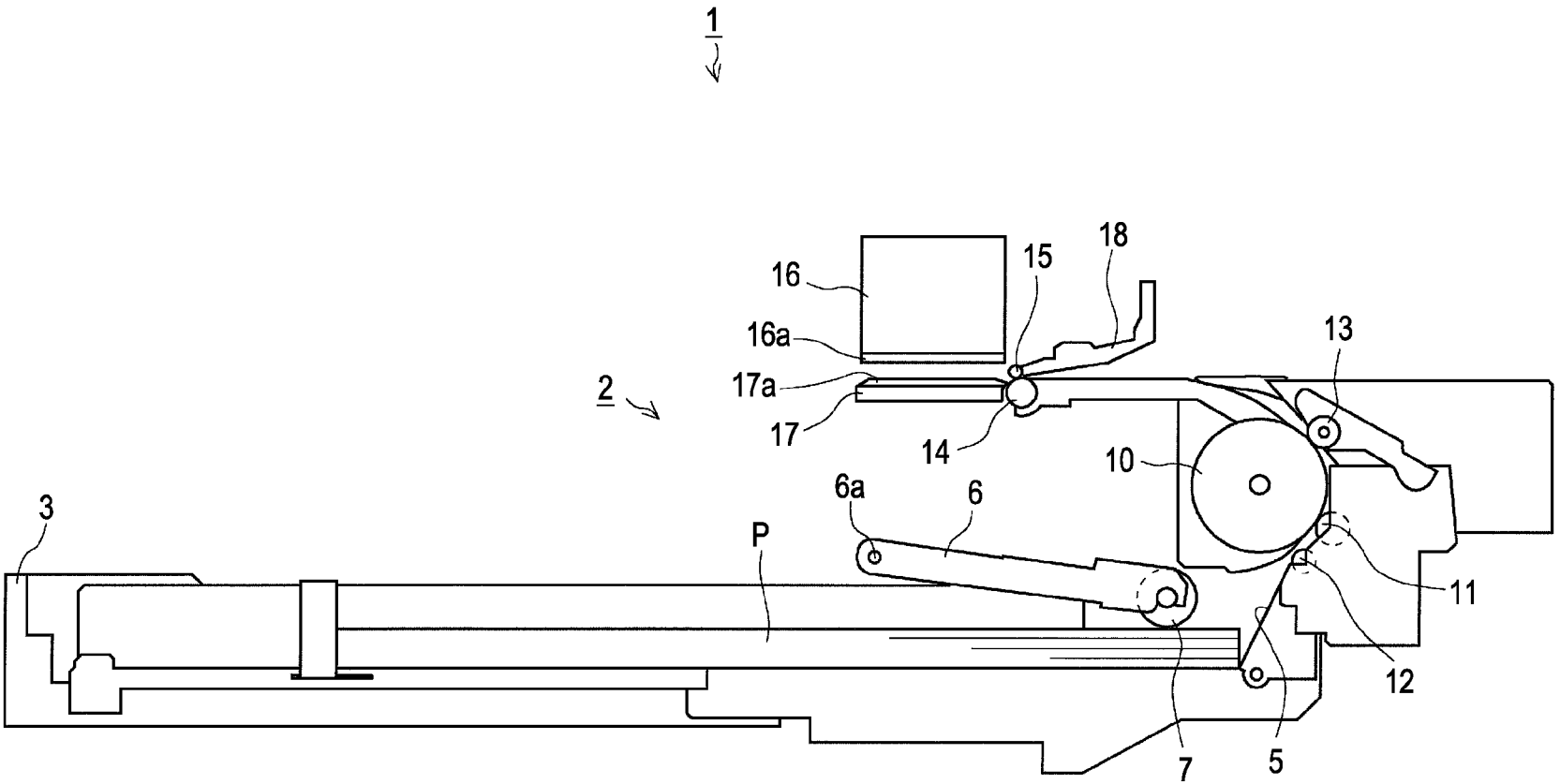
FIG. 1 is a schematic sectional side view of a sheet transportation path of a printer according to the present invention.
Figure 2:
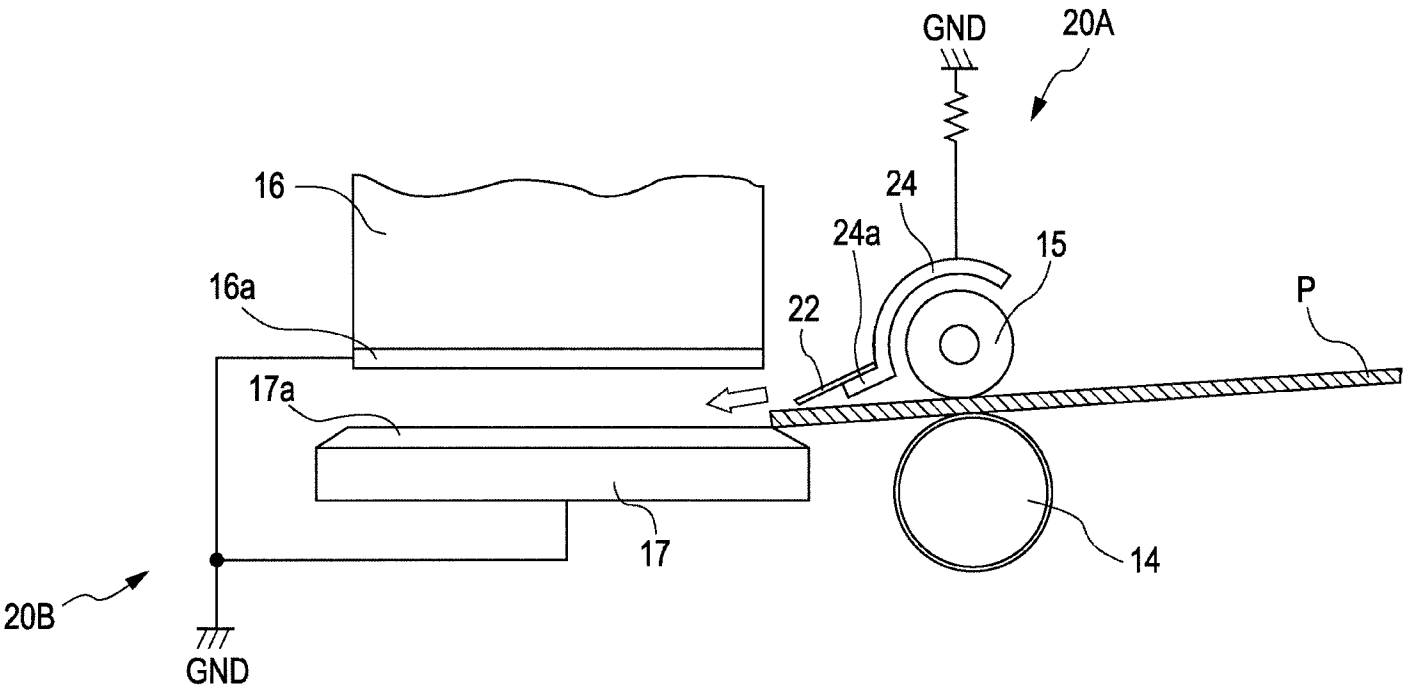
FIG. 2 is a side view of a recording execution section in the printer according to the present invention.
Figure 3:
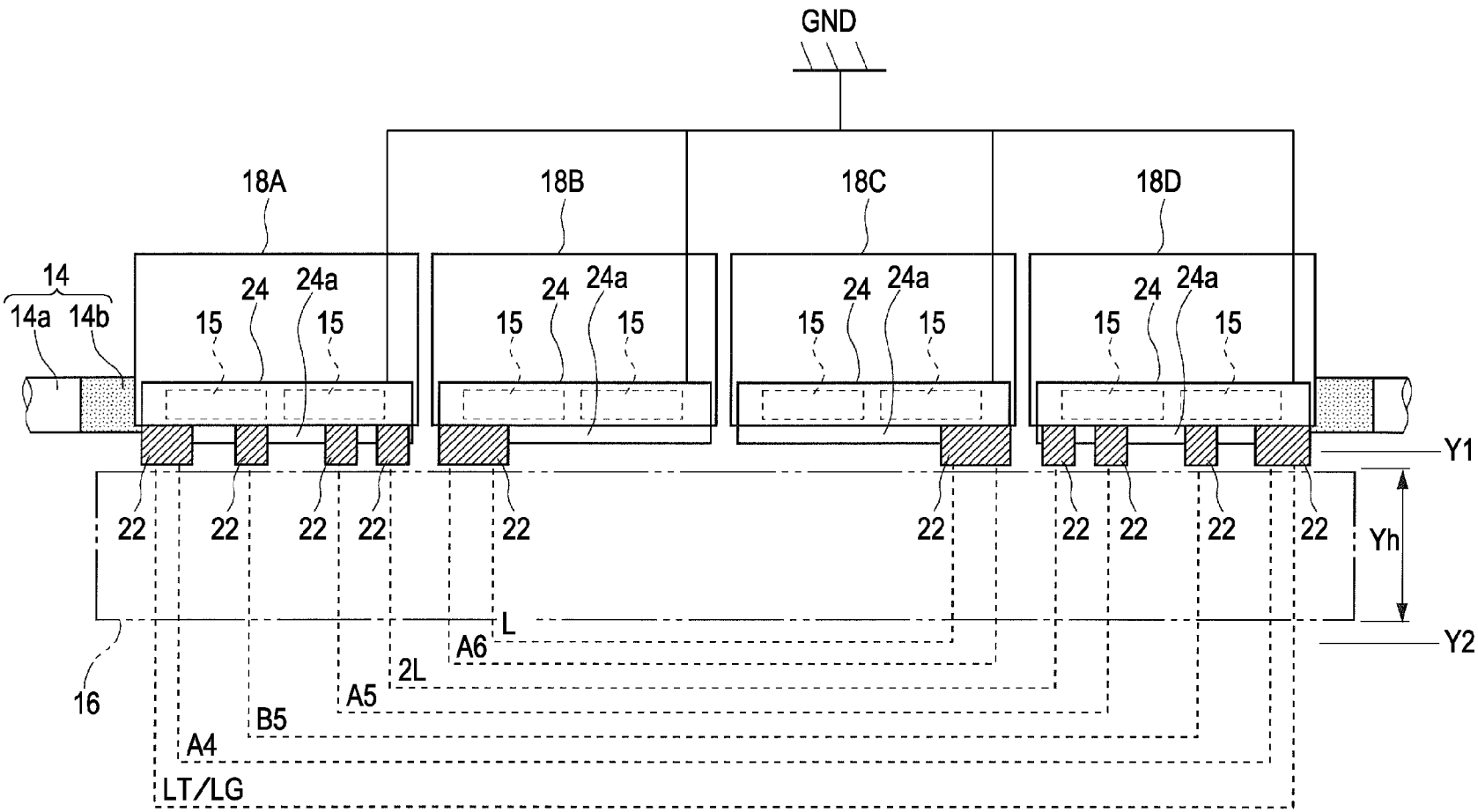
FIG. 3 is a plan view of the recording execution section in the printer according to the present invention.
Figure 4:
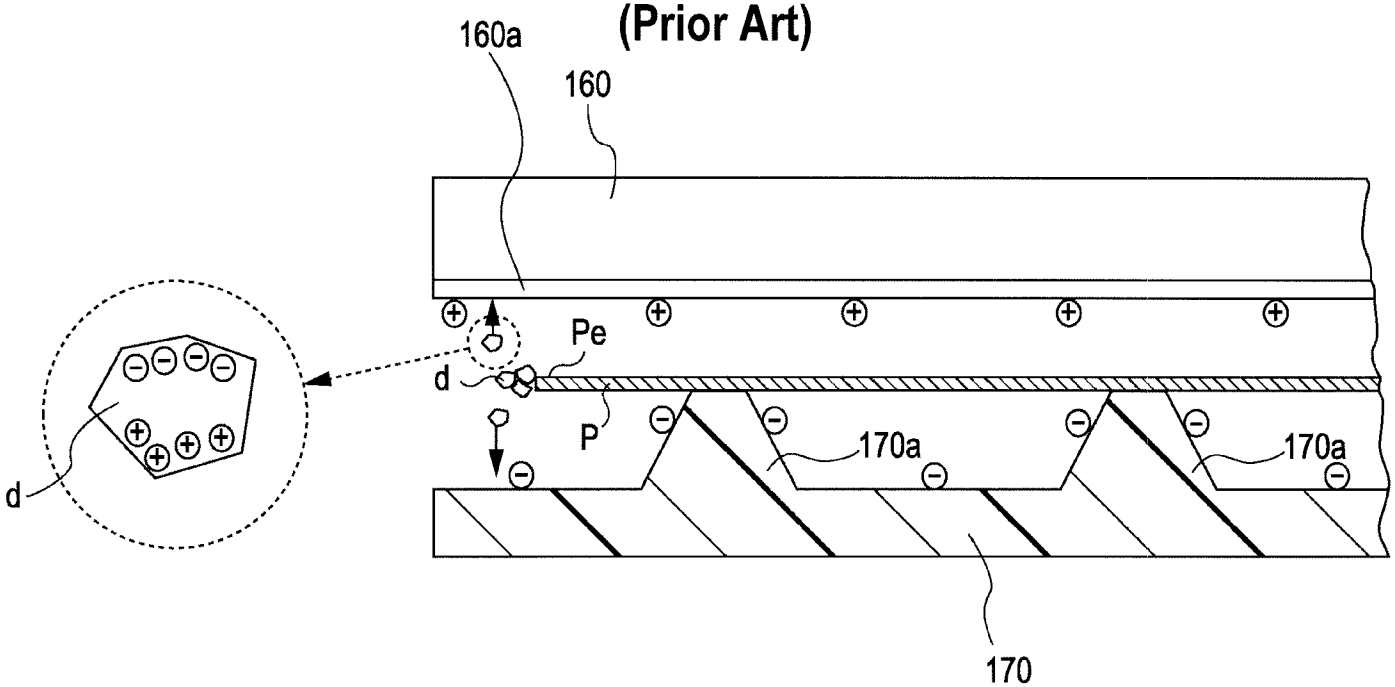
FIG. 4 (Prior Art)
FIG. 4 is an explanatory view for explaining the problems of the related art.

Embodiments of the invention will be described below with reference to the accompanying drawings. FIG. 1 shows a schematic sectional side view of a sheet transportation path of an ink jet printer 1 in accordance with the invention. FIGS. 2 and 3 show a side view and a plan view of a recording execution section in the ink jet printer 1, respectively.

Referring to FIG. 1, an overall configuration of the ink jet printer 1 which is common to the respective embodiments will be briefly described. The ink jet printer 1 includes a sheet feeder 2 in the bottom portion of the apparatus and is configured such that a recording sheet P, as an example of a target ejection medium, is fed out of the sheet feeder 2 via an intermediate roller 10, around which the recording sheet P is turned and reversed, to an ink jet recording head 16 as a liquid ejecting unit to perform recording.

More specifically, the sheet feeder 2 includes a sheet cassette 3, a pickup roller 7, the intermediate roller 10, a retard roller 11 and guide rollers 12 and 13. The sheet cassette 3 is removably mounted in the sheet feeder 2 and accommodates a plurality of the recording sheets P. A separation slope 5 is disposed at a position opposing the leading edges of the recording sheets P. The recording sheets P are fed downstream by the pickup roller 7, with their leading edges being in sliding contact with the separation slope 5. This allows for preliminary separation of the uppermost sheet P that is intended to be fed from the subsequent sheets P, preventing the subsequent sheets P from being fed along with the uppermost sheet P.

The pickup roller 7 which constitutes a sheet feeding unit is supported by a pivot member 6 which pivotally moves about a pivot shaft 6*a* in a clockwise direction and a counterclockwise direction as viewed in FIG. 1 and is driven to rotate by power from a drive motor (not shown). During sheet feeding, the pickup roller 7 rotates while being in contact with the uppermost one of the recording sheets P accommodated in the sheet cassette 3, thereby feeding the uppermost recording sheet P one by one from the sheet cassette 3.

Then, the recording sheet P fed out of the sheet cassette 3 is advanced to a turning section. Within the turning section, the intermediate roller 10, the retard roller 11 and the guide rollers 12 and 13 are disposed.

The intermediate roller 10 is a large diameter roller which forms the inner curve of the turning path, around which the recording sheet P is turned and reversed, and is driven to rotate by a drive motor (not shown). As the intermediate roller 10 rotates in a counterclockwise direction, the recording sheet P is wound by the roller and fed downstream.

The retard roller 11 is provided so as to be movable into pressing contact and out of pressing contact with the intermediate roller 10 with a given rotation frictional resistance. The retard roller 11 cooperates with the intermediate roller 10 to nip the recording sheet P therebetween, causing the uppermost recording sheet P intended to be fed to be separated from the subsequent sheets P, preventing them from being fed along with the uppermost sheet P.

In addition, in this region of the sheet feeding path, a sheet return lever (not shown in the figure) is provided which operates to return the subsequent sheets P which have been stopped advancing by the retard roller 11 back to the sheet cassette 3.

The guide rollers 12 and 13 are freely rotatable rollers. One of which, the guide roller 13 cooperates with the intermediate roller 10 to nip the recording sheet P therebetween, thereby assisting the intermediate roller 10 to feed the recording sheet P.

The overall configuration of the sheet feeder 2 has been described hereinabove. The ink jet printer is provided with the sheet feeder 2 and further includes a sheet transportation unit, which includes a transport driving roller 14 and a transport driven roller 15, downstream from the intermediate roller 10. The transport driving roller 14 is driven to rotate by a drive motor (not shown in the figure), while the transport driven roller 15 cooperates with the transport driving roller 14 to nip the recording sheet P therebetween and is rotated in accordance with the transportation of recording sheet P.

In addition, a reference numeral 18 denotes an upper guide member, by which the transport driven roller 15 is supported in a freely rotatable manner. In accordance with this embodiment, a plurality of the upper guide members 18 are arrayed in the axis line direction of the transport driving roller 14 (as shown in FIG. 3). In this embodiment, two transport driven rollers 15 are rotatively supported by the respective upper guide member 18. Also in this embodiment, the transport driving roller 14 has a metallic shaft body with its surface partially coated with abrasion resistant particles in order to enhance the frictional force between the surface and the recording sheet P, wherein a reference numeral 14*a* denotes a metallic surface which is not coated with abrasion resistant particles, while a reference numeral 14*b* denotes a high friction surface which is coated with abrasion resistant particles, as shown in FIG. 3.

Referring again to FIG. 1, downstream from the transport driving roller 14 is a recording section, where recording on the recording sheet P is performed. In the recording section, the ink jet recording head 16 as a liquid ejecting unit and the support member 17 are disposed so as to oppose each other, such that a distance is defined between the ink jet recording head 16 and the recording sheet P supported by the support member 17.

A reference numeral 16*a* denotes a metallic nozzle plate which forms a first side of the ink jet recording head 16 which opposes the support member 17 and has a plurality of ink ejecting nozzles (not shown in the figure) disposed therein. A reference numeral 17*a* denotes ribs that are formed on the support member 17 and extend in a sheet feeding direction (a first direction: horizontal as viewed in FIG. 1). The plurality of ribs 17*a* are disposed in a sheet width direction (a second direction: perpendicular to the plane of FIG. 1) appropriately spaced from each other and adapted to support the recording sheet P.

In this embodiment, the ink jet recording head 16 is a so-called line head, the length of which covers the sheet width, and enables recording by simply sending the recording sheet P in the transportation direction (the first direction) without reciprocating the inkjet recording head 16 in the sheet width direction (the second direction). However, the recording sheet P is not limited to the above and may be a serial type, which perform recording while moving in the sheet width direction.

The recording sheet P is brought between the inkjet recording head 16 and the support member 17 (to the recording section), where recording is performed, and then discharged out of the apparatus by means of a discharge member (not shown in FIG. 1).

The overall configuration of the ink jet printer 1 has been described above and the features of the configuration of the recording section will now be described below. Referring to FIGS. 2 and 3, a reference numeral 24 denotes a cover which covers the outer peripheral surface of the transport driven roller 15. There are provided a plurality of covers 24 mounted in the respective upper guide members 18 (shown as reference numerals 18A to 18D in FIG. 3), by which the transport driven rollers 15 are rotatively supported.

As shown in FIG. 2, the cover 24 is formed so as to cover the outer peripheral surface of the transport driven roller 15, specifically a side closer to the ink jet recording head 16. As shown in FIG. 3, each cover 24 is designed to have a width that extends across two transport driven rollers 15 in the respective upper guide members 18.

The cover 24 is formed so as not to be in contact with the outer peripheral surface of the transport driven roller 15 and is provided with a flange 24*a* downstream from the sheet feeding path (left hand side of the cover 24 as viewed in FIG. 2). The flange 24*a* has a conductive shielding member 22 provided thereon.

The conductive shielding member 22 is a sheet-shaped thin plate and is provided as an electric conductive member in this embodiment. As shown in FIG. 3, a plurality of the conductive shielding member 22 are provided over a first side (a front side which is opposing the ink jet recording head 16) of the recording paper P in the edge area including the edge in such a manner that they are not in contact with the recording sheet P.

In addition, the plurality of the conductive shielding members 22 are provided so as to accommodate different sizes of the recording sheets P (the conductive shielding members 22 are shown by hatching in FIG. 3). Note that rectangular shapes illustrated in a transparent manner in FIG. 3 with sheet size indications such as "LT/LG", "A4" and "B5" represent the respective recording sheets P of different sizes. Also, in FIG. 3, a plurality of upper guide members 18 are arrayed in the sheet width direction, each of which is shown with appended letters (A to D) for the purpose of distinguishing their respective positions.

Turning to FIG. 2, reference numerals 20A and 20B denote equipotential forming units. In this embodiment, the equipotential forming units 20A and 20B are adapted to set the same potential to the cover 24, the conductive shielding member 22, the nozzle plate 16*a* and the support member 17.

More specifically, the cover 24 and the support member 17 are resin components which are made to be electrically conductive with a surface resistance about 102 to 108Ω/□ since they are made of resin mixed with electrically conductive materials such as a metal, carbon and the like. The conductive shielding member 22 is electrically connected to the cover 24, which in turn is connected to ground through the ground resistance.

Further, the nozzle plate 16*a* and the support member 17 are also connected to ground. Therefore, the cover 24, the conductive shielding member 22, the nozzle plate 16*a* and the support member 17 become the same potential, resulting in no electric field applied to them (no electric field state).

With the foregoing configuration, effects and advantages are achieved in the recording section of the ink jet printer 1 as described below. First, the conductive shielding members 22 cover the edge area of the recording sheet P where paper dust adhesion is most likely to occur, thereby physically preventing paper dust from flying toward the nozzle plate 16*a*. In addition to being electrically conductive, the conductive shielding members 22 are provided so as not to be in contact with the recording sheet P, therefore they will not physically scrape paper dust, which is attached to the edge area of the recording sheet P, thereby eliminating flying paper dust. Further, without friction between the conductive shielding members 22 and the recording sheet P, frictional charging on paper dust can be prevented, thereby eliminating flying paper dust caused by electrostatic charge. Note that the width from the edge the recording sheet P to be covered by the conductive shielding members 22 can be appropriately adjusted according to the adhesion status of the paper dust d. For example, the width from the edge may be set to about 2 mm inside the edge around which the maximum paper dust adhesion is found or, alternatively, may be set with some margins, for example 2 to 5 mm inside the edge, thus allowing for an appropriate adjustment according to the adhesion status of the paper dust d.

Next, the equipotential forming units 20A and 20B may set the same potential to the cover 24, the conductive shielding member 22, the nozzle plate 16*a* and the support member 17, resulting in no electric field being applied to them (no electric field state). In other words, since there is no electric field, no Coulomb force acts on the paper dust, and therefore more reliable prevention of paper dust from flying toward the nozzle plate 16*a* and adhering thereto can be achieved.

In the case where the recording sheet P is relatively thick, the conductive shielding member 22 may come into contact with the surface of the recording sheet P. Therefore, it is desirable to mount the conductive shielding member 22 in accordance with the recording sheet having the maximum thickness among all types (thickness) of the recording sheets that are intended to be used, in order to ensure the conductive shielding member 22 and the recording sheet P are not in contact with each other.

Modifications of the Above Described Embodiment (1) Cover

While the cover 24 that covers the transport driven roller 15 has been described as being not in contact with the recording sheet P in the above embodiment, the cover 24 may be configured such that a middle area of the cover 24, or at least the area except for the portion corresponding to the edge area of the recording sheet P, comes into contact with the recording sheet P. More specifically, as shown in FIG. 3, the flanges 24*a* formed on the covers 24 provided on the upper guide members 18B and 18C, respectively, may be configured such that parts of the flanges 24*a* except for the portion corresponding to the edge area of the recording sheet P come into contact with the recording sheet P.

With this configuration, the recording sheet P and thus paper dust is brought to the same potential as the nozzle plate 16*a* before the recording sheet P arrives at the support member 17. Therefore, it is possible to more reliably prevent paper dust from flying toward the nozzle plate 16*a* and adhering thereto. Further, when the cover 24 is disposed in such a manner to be rotatable in a clockwise direction and a counterclockwise direction as viewed in FIG. 2 and the flange 24*a* is biased by a biasing unit so as to be in elastic contact with the recording sheet P, the flange 24*a* can be in contact with the recording sheet P, while accommodating various thickness and the changes in position of the recording sheet P in a flexible manner.

Even with such a configuration in which the flange 24*a* of the cover 24 comes in contact with the recording sheet P, it is still preferable to keep the cover 24 not in contact with the recording sheet P in the edge area, where a significant amount of paper dust is attached. This allows paper dust not to be scraped by the flange 24*a* and prevents paper dust from flying.

While the cover 24 has been described as being electrically conductive and connected to ground in the above embodiment, the cover 24 may be electrically insulative. In this case, it is preferable to directly connect the conductive shielding member 22 to ground in order to keep it at the same potential as the nozzle plate 16*a* and the like.

(2) Conductive Shielding Member

In the above described embodiment, the conductive shielding member 22 is disposed in the sheet transportation path between the sheet transportation member which includes the transport driving roller 14 and the transport driven roller 15 and the ink jet recording head 16, specifically downstream and in the vicinity of the transport driven roller 15, as indicated by Y1 in FIG. 3. This makes it possible to effectively prevent paper dust from flying toward the nozzle plate 16*a* and adhering thereto, especially when paper dust is released from the recording sheet P due to vibration as the trailing edge of the recording sheet P passes through between the transport driving roller 14 and the transport driven roller 15.

However, the conductive shielding member 22 may be disposed at any point without being limited to the above described embodiment as long as the prevention of paper dust from flying toward the nozzle plate 16*a* can be achieved. For example, the conductive shielding member 22 may be disposed downstream and in the vicinity of the recording section (represented by Yh in FIG. 3) where recording is performed by the ink jet recording head 16, as indicated by Y2 in FIG. 3. Note that the conductive shielding member 22 may be disposed within the recording section, however borderless recording on the recording sheet P is possible only when the conductive shielding member 22 is disposed outside the recording section.

Further, the conductive shielding member 22 may be made of a variety of electrically conductive materials. Using a material for the conductive shielding member 22 that is more positive in the triboelectric series (for example, conductive nylon) relative to the material of the recording sheet P enables the electrostatic charging of paper dust to be reduced more effectively, when the recording sheet P used for recording has paper dust substantially containing cellulose fibers, which tend to be positively charged.

Alternatively, using a material for the conductive shielding member 22 that is more negative in the triboelectric series (for example, conductive PET or conductive Teflon (registered trademark)) relative to the material of the recording sheet P enables the electrostatic charging of paper dust to be reduced more effectively, when the recording sheet P used for recording has paper dust substantially containing calcium carbonate, which tends to be negatively charged.

Further, the conductive shielding member 22 may be formed to have an electric conductivity with a surface resistance of for example about 102 to 108Ω/□ as described above, the prevention of paper dust adhesion to the conductive shielding member 22 may be achieved with a certain amount of resistance.

(3) Equipotential Forming Unit

In the above described embodiment, the equipotential forming units 20A and 20B are provided to set the same potential to the cover 24, the conductive shielding member 22, the nozzle plate 16*a* and the support member 17. However, all of them do not necessarily have to be the same potential. For example, only the conductive shielding member 22 and the nozzle plate 16*a* may be set to the same potential, and this results in there being no electric field between those components, and thus works effectively for paper dust. In other words, when any of the components are at the same potential, there will be no electric field across those components, and therefore it is also possible to prevent paper dust from flying.

Further, in addition to a connection to ground, the components may be set to the same potential by applying a certain level of voltage of any polarity thereto. In other words, when any two components are at the same potential, no electric field is generated therebetween, which is effective for the prevention of flying paper dust.

(4) Nozzle Plate

In the above described embodiment, a water repellent film may be provided on the surface of the nozzle plate 16*a*. When the water repellent film is electrically conductive, it is possible to prevent the water repellent film from becoming electrically charged, and thus prevent paper dust adhesion to the nozzle plate 16*a*, thereby reliably controlling the electric potential of the nozzle plate 16*a*.

Alternatively, when the water repellent film is electrically insulative, it is possible to reduce an image force acting on the nozzle plate 16*a*, which is made of metal such as SUS (mutual attraction of charges of opposite polarity which occurs when charged paper dust approaches the nozzle plate and induces opposite charges on the surface of the nozzle plate 16*a*), thereby preventing paper dust which is flying near the nozzle plate 16*a* from being attracted to the nozzle plate 16*a*.

An electric potential may be applied (controlled) to the ink jet recording head 16 preferably at a point closest to the support member 17, which is on the nozzle plate 16*a*, and more specifically, on the nozzle surface which faces to the support member 17. Thus, an electric potential on the nozzle surface which is closest to the recording sheet P can be controlled, thereby reliably preventing paper dust adhesion to the nozzle surface as well as reducing the electric field from the surroundings. This applies with respect to the support member 17 as well. An electric potential may be controlled on the support member 17, preferably on the surface which opposes the nozzle plate 16*a*.

(5) Applying Electric Charge to Ink Droplets

In the above described embodiment, ink droplets are electrically charged by inductive charging via the nozzle plate 16*a* (when a certain electric potential is applied to the nozzle plate 16*a*, for example). However, the ink droplets may be electrically charged at any point in the ink flow path from an ink storage chamber (such as an ink cartridge) for storing the ink to the nozzle plate 16*a*. For example, part or all of the inner wall of the ink storage chamber may be formed of an electric conductive material so as to apply electric charge to the ink droplets via the inner wall.

By applying the same potential to the ink in the form of liquid as that of the conductive shielding member 22 (or alternatively, the recording sheet P, the support member 17 or the like), the electric field generated between the ink jet recording head 16 and the conductive shielding member 22 (or alternatively, the recording sheet P, the support member 17 or the like) can be reduced drastically. This can also prevent paper dust adhesion to the nozzle plate 16*a*. That is, the nozzle plate 16*a*, for example, may be formed of a dielectric material such as silicone, acrylic or polyimide, as well as a conductive material such as a metal. In that case, a potential difference between the ink within the ink jet recording head 16 and the support member 17 may cause an electric field that has a strong effect on paper dust, which leads to paper dust flying toward the nozzle plate 16*a*, without controlling the electric potential of the ink within the ink jet recording head 16. However, this problem may be solved by applying the same potential to the ink within the ink jet recording head 16 as that of the support member 17.

Alternatively, when the nozzle plate 16*a* is formed of a dielectric material, the nozzle plate 16*a* may be configured such that a portion of the ink flow path that passes through the nozzle plate 16*a* (i.e., a portion of the nozzle plate 16*a* that is exposed to the ink flow) is formed of an electric conductive material. With this configuration, it is possible to apply electric potential to the ink within the ink jet recording head 16 via the electric conductive material. When the nozzle plate 16*a* is formed so as to have a layered structure, a portion of the ink flow path that passes through all the layers may be formed of an electric conductive material or, alternatively, a portion of the ink flow path that passes through at least one of the layers may be formed of an electric conductive material.

What is claimed is:

1. A liquid ejecting apparatus comprising:

a liquid ejecting unit that ejects liquid toward a target ejection medium;

a target ejection medium support member that is disposed so as to oppose the liquid ejecting unit and supports the target ejection medium;

a conductive shielding member that covers a first side of the target ejection medium without contacting the target ejection medium so as to not influence the transportation of the target ejection medium, which opposes the liquid ejecting unit, at an edge area including an edge perpendicular to a feeding direction of the target ejection medium; and a target ejection medium transportation unit that is disposed upstream from the liquid ejecting unit, wherein the conductive shielding member is disposed in the feeding direction of the target ejection medium between the liquid ejecting unit and the target ejection medium transportation unit, wherein the target ejection medium transportation unit includes:

a roller configured to rotate while being in contact with the first side of the target ejection medium; and a cover member that covers an outer peripheral surface of the roller, and wherein the conductive shielding member is mounted on the cover member.

2. The liquid ejecting apparatus according to claim 1, wherein the target ejection medium transportation unit includes:

a roller configured to rotate while being in contact with the first side of the target ejection medium; and a cover member that covers an outer peripheral surface of the roller, the cover member having a contact portion formed thereon which is in contact with the target ejection medium, wherein the conductive shielding member is mounted on the cover member, and wherein the cover member is electrically conductive and connected to an equipotential forming unit so that the cover member is set to the same potential as that of a specified portion of the liquid ejecting unit and the conductive shielding member.

3. The liquid ejecting apparatus according to claim 1, wherein the cover member is configured to not be in contact with the first side of the target ejection medium at least at the edge area.

4. A liquid ejecting apparatus comprising:

a liquid ejecting unit that ejects liquid toward a target ejection medium;

a target ejection medium support member that is disposed so as to oppose the liquid ejecting unit and supports the target ejection medium; and a conductive shielding member that covers a first side of the target ejection medium without contacting the target ejection medium so as to not influence the transportation of the target ejection medium, which opposes the liquid ejecting unit, at an edge area including an edge perpendicular to a feeding direction of the target ejection medium, wherein a plurality of the conductive shielding members are provided and arrayed in a direction perpendicular to the feeding direction of the target ejection medium so as to accommodate different sizes of the target ejection mediums.

5. A liquid ejecting apparatus comprising:

a liquid ejecting unit that ejects liquid toward a target ejection medium;

a target ejection medium support member that is disposed so as to oppose the liquid ejecting unit and supports the target ejection medium;

a conductive shielding member that covers a first side of the target ejection medium without contacting the target ejection medium so as to not influence the transportation of the target ejection medium, which opposes the liquid ejecting unit, at an edge area including an edge perpendicular to a feeding direction of the target ejection medium;

a roller configured to rotate while being in contact with the first side of the target ejection medium; and a cover member that covers an outer peripheral surface of the roller, wherein the conductive shielding member is mounted on the cover member.

* * * * *